US007992851B2

(12) United States Patent
Vieira et al.

(10) Patent No.: US 7,992,851 B2
(45) **Date of Patent: *Aug. 9, 2011**

(54) DEVICE FOR AUTOMATIC INDEXING OF A GOLF BALL

(75) Inventors: Michael F. Vieira, Acushnet, MA (US); Thomas L. Mydlack, Rochester, MA (US); Edmund T. Maher, Fairhaven, MA (US); Thomas E. Moore, Warren, RI (US)

(73) Assignee: Acushnet Company, Fairhaven, MA (US)

( * ) Notice: Subject to any disclaimer, the term of this patent is extended or adjusted under 35 U.S.C. 154(b) by 1042 days.

This patent is subject to a terminal disclaimer.

(21) Appl. No.: 11/832,116

(22) Filed: Aug. 1, 2007

(65) Prior Publication Data

US 2009/0031904 A1 Feb. 5, 2009

(51) Int. Cl.
*B25B 11/00* (2006.01)

(52) U.S. Cl. ..... 269/8; 248/349.1; 279/128

(58) Field of Classification Search ... 269/8; 248/349.1, 248/346.5, 521; 409/163–168, 189, 197–199, 409/200, 205, 219–226; 279/128; 74/813 R–813 L
See application file for complete search history.

(56) References Cited

U.S. PATENT DOCUMENTS 1,343,751 A * 6/1920 Simmons ..... 335/287
1,673,825 A * 6/1928 Hoffmann ..... 273/148 A
1,936,808 A * 11/1933 Franklin ..... 451/247
3,024,018 A * 3/1962 Manz ..... 248/349.1
3,027,810 A * 4/1962 Mueller ..... 89/37.01
3,615,068 A * 10/1971 Edelstein ..... 248/349.1
3,841,199 A * 10/1974 Jepson et al. ..... 409/80
4,549,714 A * 10/1985 Busch ..... 248/349.1
4,635,894 A * 1/1987 Sammons ..... 248/558
4,717,112 A * 1/1988 Pirkle ..... 248/639
5,429,345 A * 7/1995 Yang ..... 269/71
5,777,244 A 7/1998 Kumagai et al.
5,859,923 A 1/1999 Petry, III et al.
6,031,933 A 2/2000 Kumagai
6,061,086 A 5/2000 Reimer et al.
6,220,116 B1 * 4/2001 Warner ..... 74/813 C
6,462,812 B1 10/2002 Heene et al.
6,490,968 B2 12/2002 Lutz et al.
6,630,998 B1 10/2003 Welchman et al.
6,809,822 B2 10/2004 Welchman et al.
6,825,931 B2 11/2004 Welchman et al.
6,839,138 B2 1/2005 Welchman et al.
6,886,225 B2 * 5/2005 Pasquetto ..... 29/27 C
6,923,115 B1 * 8/2005 Litscher et al. ..... 101/35
7,048,651 B2 5/2006 Kennedy, III et al.
(Continued)

*Primary Examiner* — George Nguyen
(74) *Attorney, Agent, or Firm* — D. Michael Burns

(57) ABSTRACT

The present invention is directed to a magnetic indexing device that can be connected to a conveyor, the device firmly holding a golf ball in a particular orientation for the purposes of printing of indicia and logo on the ball when device and ball move along the conveyor. The device includes a stationary base portion and a rotating cup portion which are magnetically coupled to each other. Each portion has recesses for housing magnets to create a magnetic field of attraction which firmly locks the two portions together. When rotation of the cup portion to the base portion is required, the rotation is substantially friction-free because of a thrust bearing ring set in the base portion. The cup portion is caused to rotate 45° or 90° upon being biasly urged by station locks located on the conveyor. The cup portion has an open bridge section wherein cam surfaces of the station locks can engage and cause the cup portion to rotate, which is necessary for each new procedure, whether it be inspection of the ball, pad printing of indicia and logo, or curing the printed ink with ultraviolet light.

10 Claims, 9 Drawing Sheets

U.S. PATENT DOCUMENTS

| | | | | |
|---|---|---|---|---|
| 7,154,243 | B2 * | 12/2006 | Weiss | 318/560 |
| 7,162,070 | B2 | 1/2007 | Furze et al. | |
| 7,283,657 | B1 * | 10/2007 | Carlson | 382/141 |
| 7,300,043 | B1 * | 11/2007 | Lindsay et al. | 269/75 |
| 7,387,070 | B1 * | 6/2008 | Mydlack et al. | 101/492 |
| 2005/0034289 | A1 * | 2/2005 | Hosoe | 29/28 |
| 2005/0132909 | A1 | 6/2005 | Lutz | |
| 2005/0202886 | A1 | 9/2005 | Furze et al. | |
| 2006/0005718 | A1 | 1/2006 | Ohira | |
| 2006/0065137 | A1 | 3/2006 | Nguyen et al. | |
| 2006/0196372 | A1 | 9/2006 | Kennedy, III et al. | |
| 2006/0242818 | A1 * | 11/2006 | Penick et al. | 29/560 |

* cited by examiner

* Indicates position of station locks

DEVICE FOR AUTOMATIC INDEXING OF A GOLF BALL

FIELD OF THE INVENTION

This invention generally relates to a magnetic rotating device used in the indexing of a golf ball for the purpose of printing indicia on multiple surfaces. This invention more particularly relates to a device that magnetically controls the orientation of the golf ball in predetermined positions.

BACKGROUND OF THE INVENTION

More than seven hundred million golf balls are produced each year, a significant percentage of which have indicia or logos printed on their outer surface. The indicia typically include any one of the golf ball company, trade name, a number, or an image, such as a corporate or country club logo. The indicia are typically printed on a base-coated surface of the cover of the golf ball, and covered with a top-coating to prevent damage during impact with a golf club. Thus, the indicia must have a perfect appearance since it is often the most distinctive quality of a golf ball.

The golf bail cover typically contains a white or other colored concentrate, or is painted. The most common method for adding a logo to the dimpled surface of a golf ball is by pad printing, although other methods, such as inkjet printing, are adaptable for such surfaces. However, whatever method is used the golf ball must be first, oriented for the printing step(s), secondly, they must be printed on at least three sides, preferably four, and finally, there must be a method of inspection for those golf balls, which during the process have a flaw or defect in the printing.

There has been a continuing desire to achieve high production rates. Because automated apparatus typically may function faster than human operators, there has been an ongoing goal to reduce, if not eliminate, human intervention during the manufacturing process. Thus, each of the above processes is typically done at a separate automated processing station functioning at optimal efficiency and speed so that the overall production rate is maintained at the desired high level. For instance, pad-printing apparatus preferably includes an array of print-pads arranged to apply a production print sequentially on various locations on the surface of the golf ball, the golf ball being indexed before being passed to the next print-pad.

The pad printing process begins by spreading ink across the surface of a pad printing cliche or "plate" containing etched or depressed version of the desired image. Ink is dispersed over the etched area and excess ink is removed with a "doctor" blade or cup. Upon exposure to air, thinner evaporates from the ink causing it's surface to become "tacky." A smooth, resilient, block of silicone rubber (the "pad") is brought into contact with the tacky surface of the ink. As the pad is withdrawn from the plate surface, an adhering film of ink is transferred to the pad. The ink is carried on the pad to the target area on the golf ball surface, during which time thinner in the ink further evaporates, causing the exposed ink surface on the pad to become tacky. Upon contact with the golf ball surface, the film of ink is transferred from the pad to the ball surface.

Pad printing plates are typically stiff plates coated with a photopolymer material that cures upon exposure to UV light. The etched version of the image is formed by placing a film positive of the image over the plate and irradiating the surface with UV light. In this manner, the exposed areas of the plate harden, while blocked areas remain soft. The soft polymer is then removed by a series of washing steps, creating etched areas correlating to the logo.

While the golf industry needs improvement in automatically orienting, printing and inspecting golf balls produced by high speed production lines, the challenge is in the indexing of the golf ball such that multiple surfaces of the ball are presented sequentially and with extreme precision to the pad printers for the printing of indicia without interrupting the production cycle. This requires accurate indexing of the ball and the maintaining of that index.

SUMMARY OF THE INVENTION

The present invention is directed to a magnetic indexing device that firmly holds a golf ball in a particular orientation while the ball moves along a conveyor for the purpose of having indicia applied by multiple pad print heads. The device has means to cooperate with transfer mechanisms, and station locks to provide exposures of various ball surfaces for printing by articulating pad printers.

The device is comprised of a stationary base portion which is affixed to a conveyor, and a rotating cup portion which is magnetically connected to the base portion. Each portion has recesses for housing magnets that therein create a magnetic field of attraction which firmly locks the two portions together. When rotation of the cup portion to the base portion is required, the rotation is substantially friction-free because of a thrust bearing ring set in the base portion. The cup portion is caused to rotate 45° or 90° upon being biasly urged by station locks located on the conveyor. The cup portion has an open bridge section wherein cam surfaces of the station locks can engage and cause the cup portion to rotate for each new procedure, whether it be inspection of the ball, pad printing of indicia and logo, or curing the printed ink with ultraviolet light.

The device includes a hemispherical cavity having an inner surface that defines a reverse golf ball dimple pattern. A transfer mechanism takes a newly oriented ball and deposits in the hemispherical cavity and aided by slide devices, that are attached to the conveyor, flexible fingers located on opposing sides of the cavity are pushed into an open position for the reception of an oriented golf ball.

Golf balls that have indicia printed on them using the device of the present invention are placed into the apparatus in a bulk quantity. Each ball is oriented by an imaging station that uses software to load a complete pattern trajectory to a computer with a single communications transaction via Ethernet. Upon the ball being properly oriented, a transfer mechanism picks the oriented ball up and deposits it into a hemispherical cavity of a device attached to a sled on the conveyor, all while maintaining a precise predetermined relationship between the ball and the cavity, wherein the ball is firmly held in the cavity by the pair of fingers. To allow access of the ball into the hemispherical cavity, parallel sliders operate in tandem to push open the fingers to allow the depositing of the ball. The golf ball remains oriented in the cavity for the entire printing process, and since it is the cup portion of the device that is rotated, various surfaces of the ball are exposed for printing. The pad printing of indicia may include player number, brand, source of origin, logo, etc.

An object of the present invention is to reduce or eliminate wear and tear on a high speed conveyor line where all movement is automatically generated. The device provides for virtual frictionless rotation to reduce any mechanical wear by having the rotation glide over a ball bearing ring. Multiple station locks, which are located along the conveyor, engage the device and cause the cup portion to rotate (index) therein exposing a new surface for either printing, inspection, or curing. To maintain the cup in position between station locks is the function of the magnets that are disposed in the device. Magnets in the stationary base portion of the device develop a magnetic field with the magnets located in the rotating cup portion. As the devices move along the conveyor, the station locks use an engaging cam section to mesh with an open bridge section of the device to rotate it from a previous position to a new position. At the new position, printing, inspection, or curing procedures are performed, all while the station lock holds the cup device in position. Upon completion of the procedure, the station locks release the device to move along the conveyor line for the next procedure. It is the magnetic forces of the device that hold the rotating cup portion securely to the base portion. Since the device is without any mechanical locking parts, it is the magnetic force of the magnets that firmly holds the rotating portion to the base portion.

The ball held by the device is subjected to printing by multiple articulated pad print heads that employ UV curable inks supplied to each print head by a fully integrated ink viscosity control system, and the inspection of all printed sites of the ball is performed by a vision print quality inspection system which removes from the conveyor line any ball failing the inspection. A UV curing system is utilized to dry the ink. Whether it be to expose a ball surface for printing, or to expose a surface for inspection, or to expose a surface for curing, or to place the ball in position for removal from the conveyor, each step requires the device to be indexed by a station lock and subsequently held in place by the magnets between station lock positions.

BRIEF DESCRIPTION OF THE DRAWINGS

In the accompanying drawings, which form a part of the specification and are to be read in conjunction therewith and in which like reference numerals are used to indicate like parts in the various views, the drawings are.

DETAILED DESCRIPTION OF THE PREFERRED EMBODIMENTS

Figure 1:
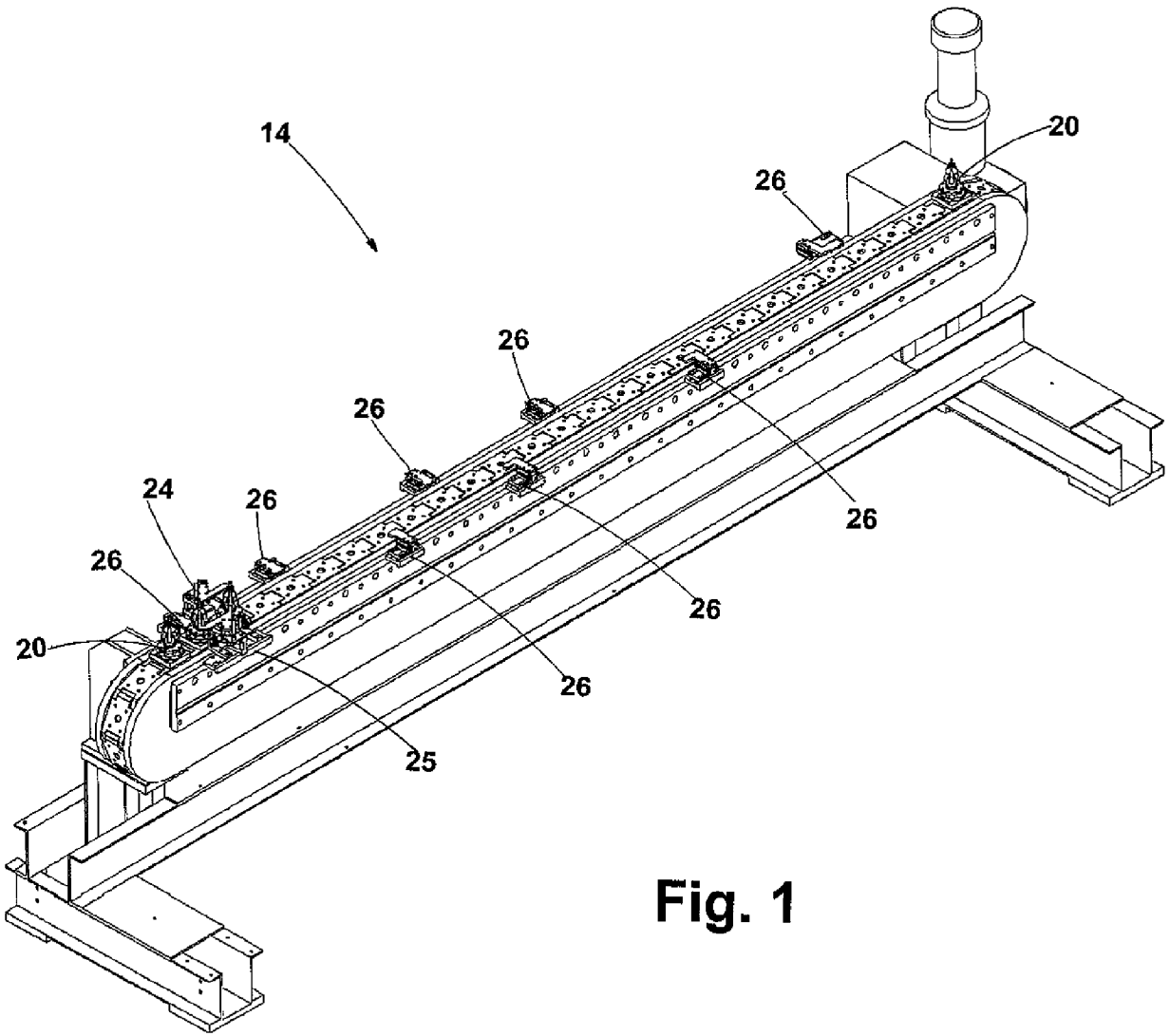
FIG. 1 is a perspective view of a conveyor illustrating the positions of the station locks and slide devices.
Figure 5:
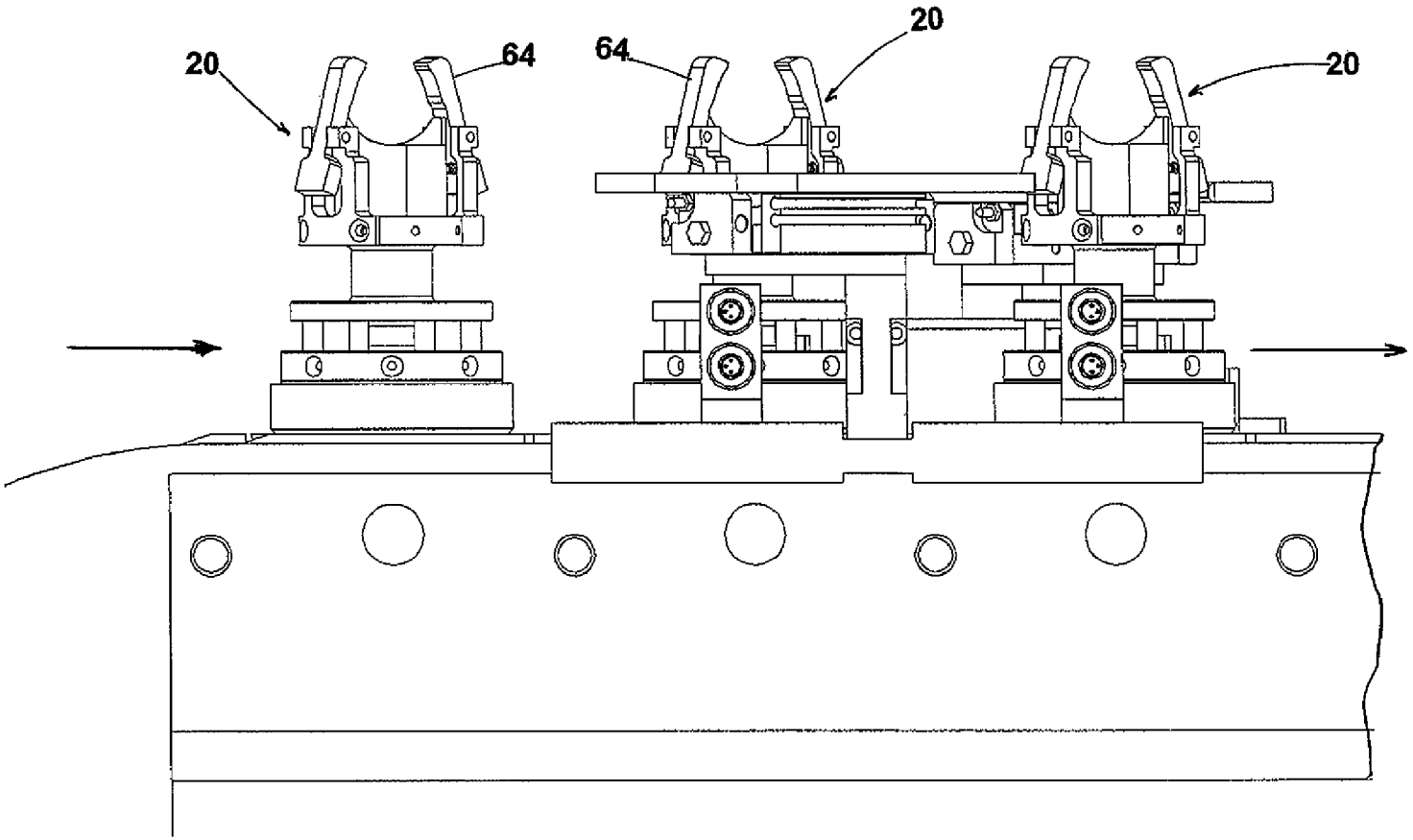
FIG. 5 is an elevational side view of a plurality of the devices while moving down the conveyor line.
Figure 6:
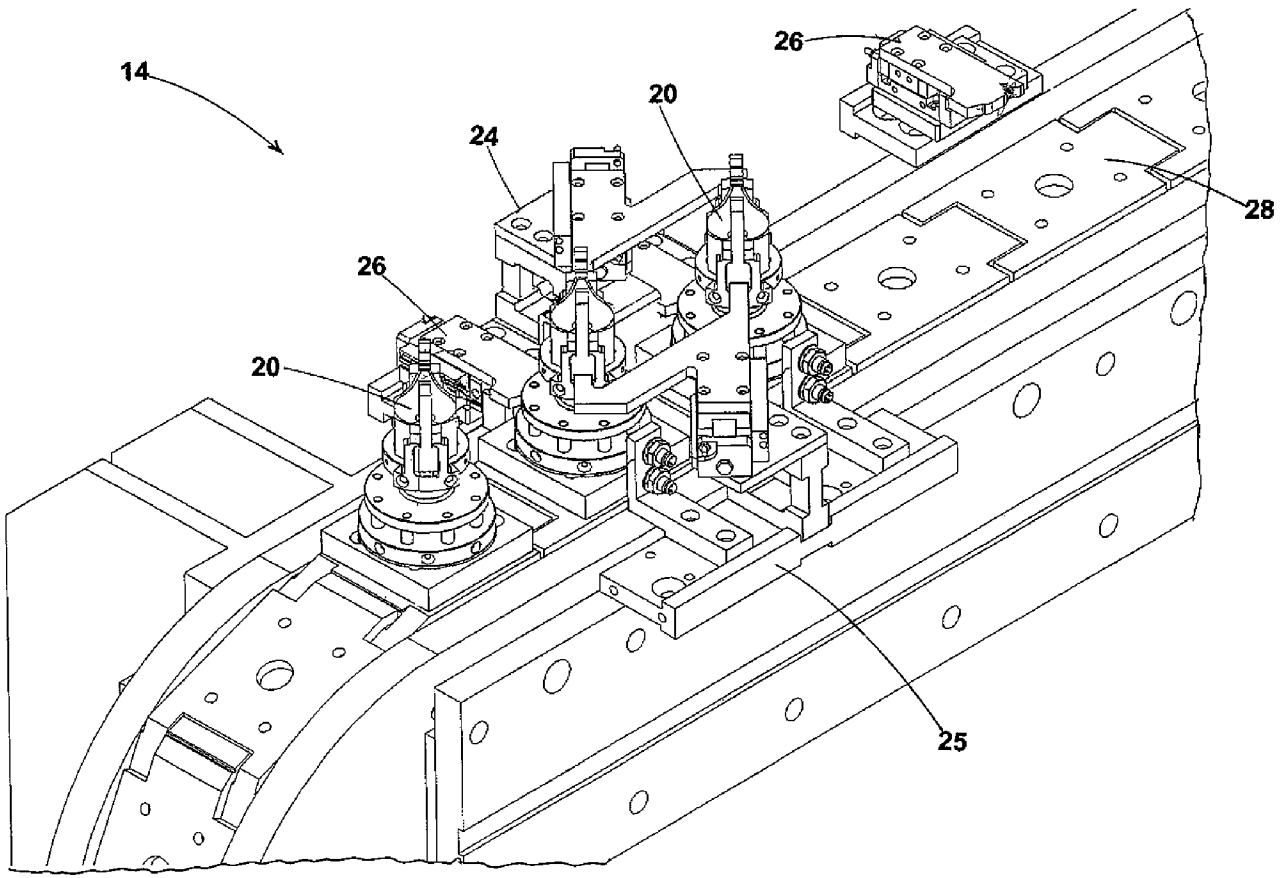
FIG. 6 is a perspective top view of a segment of the conveyor line apparatus that includes the magnetic device of the present invention with station locks to provide for horizontally indexing of the device and sliders for opening the cups for the depositing of golf balls.
Figure 7:
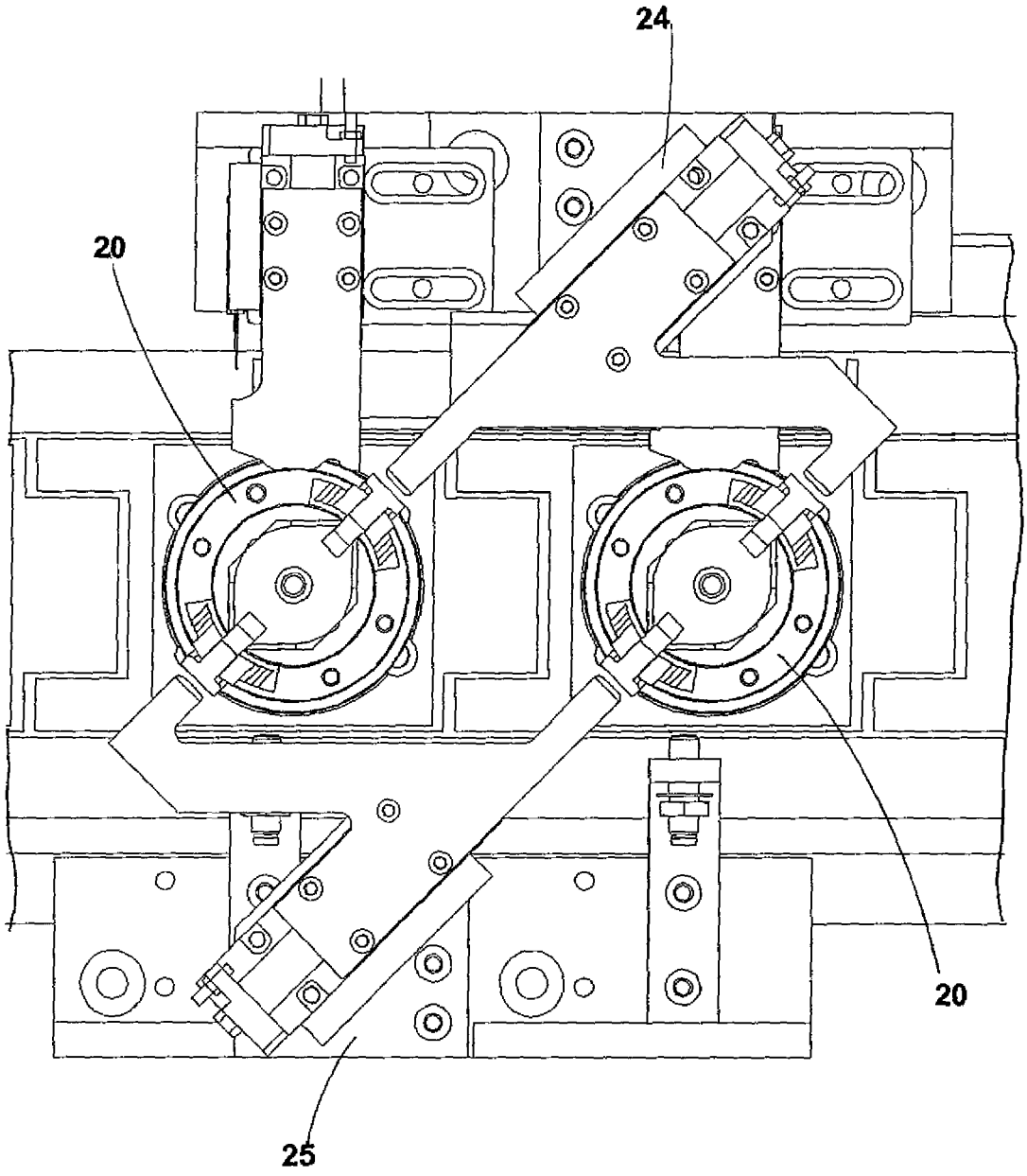
FIG. 7 is a top plan view of the device of the present invention as it engages the station lock and the sliders.
Figure 8:
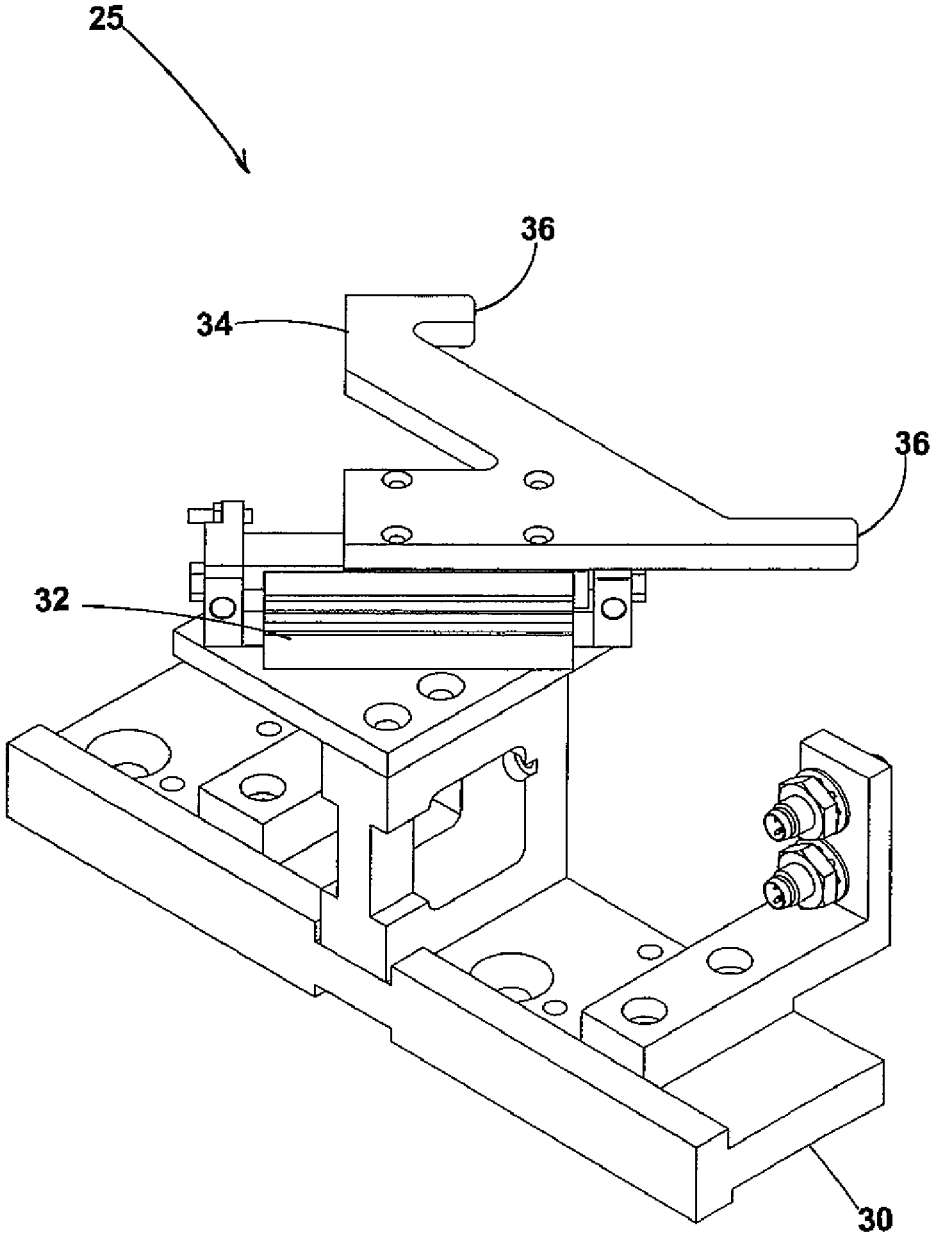
FIG. 8 is a perspective view of one of the slider members.
Figure 9:
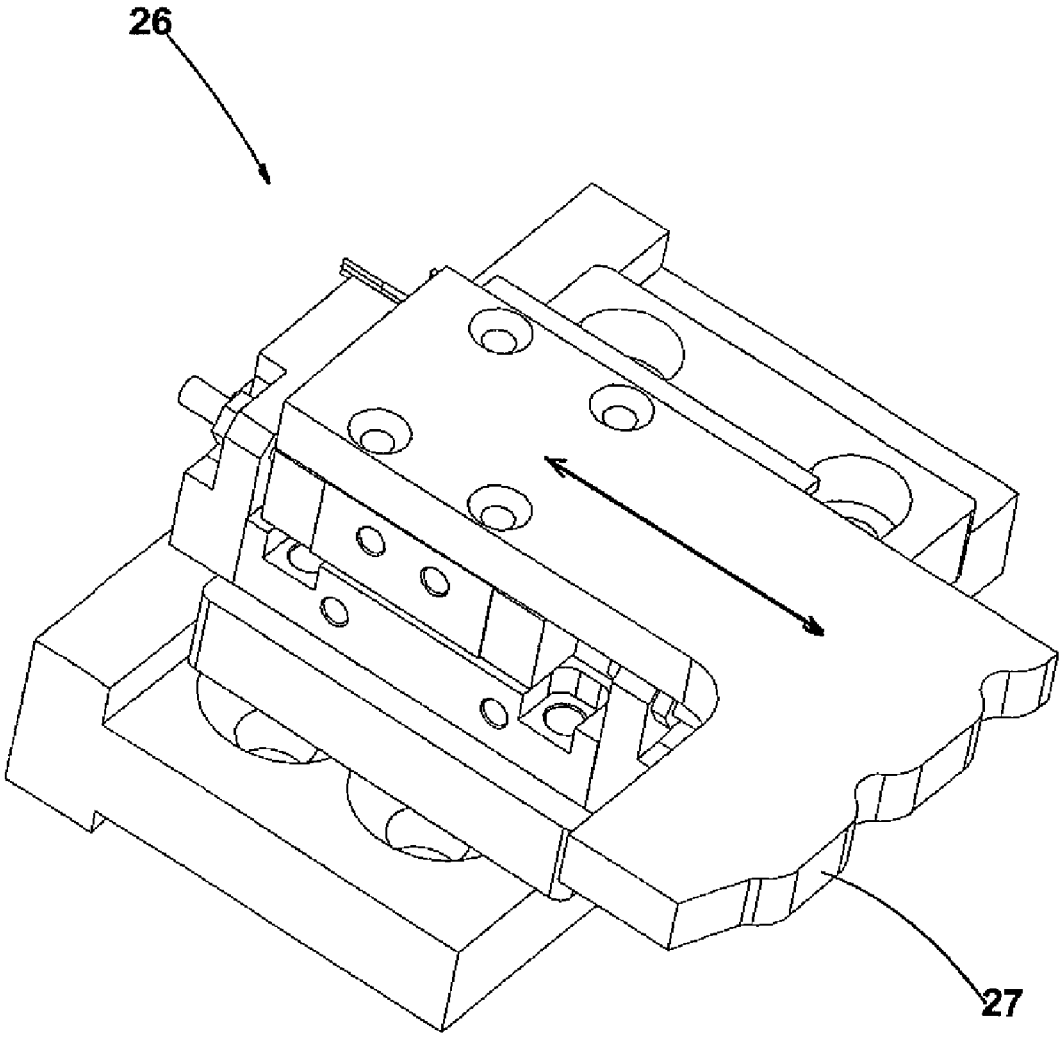
FIG. 9 is a perspective view of a station lock.

As illustrated in the accompanying drawings and discussed in detail below, one embodiment of the present invention is directed to a magnetic indexing device 20 that firmly holds a golf ball. Multiple indexing devices 20 are secured to a sled 28 on an endless conveyor 14, as shown on FIGS. 1, 5, and 6. While moving along the conveyor 14, each device 20 is precisely rotated (indexed) such that each and every held ball has the exact same surfaces exposed to articulated pad printers 16 which print indicia and logo thereupon. The balls are also indexed for inspection, curing of the ink, and removal from the device 20.

Figure 3:
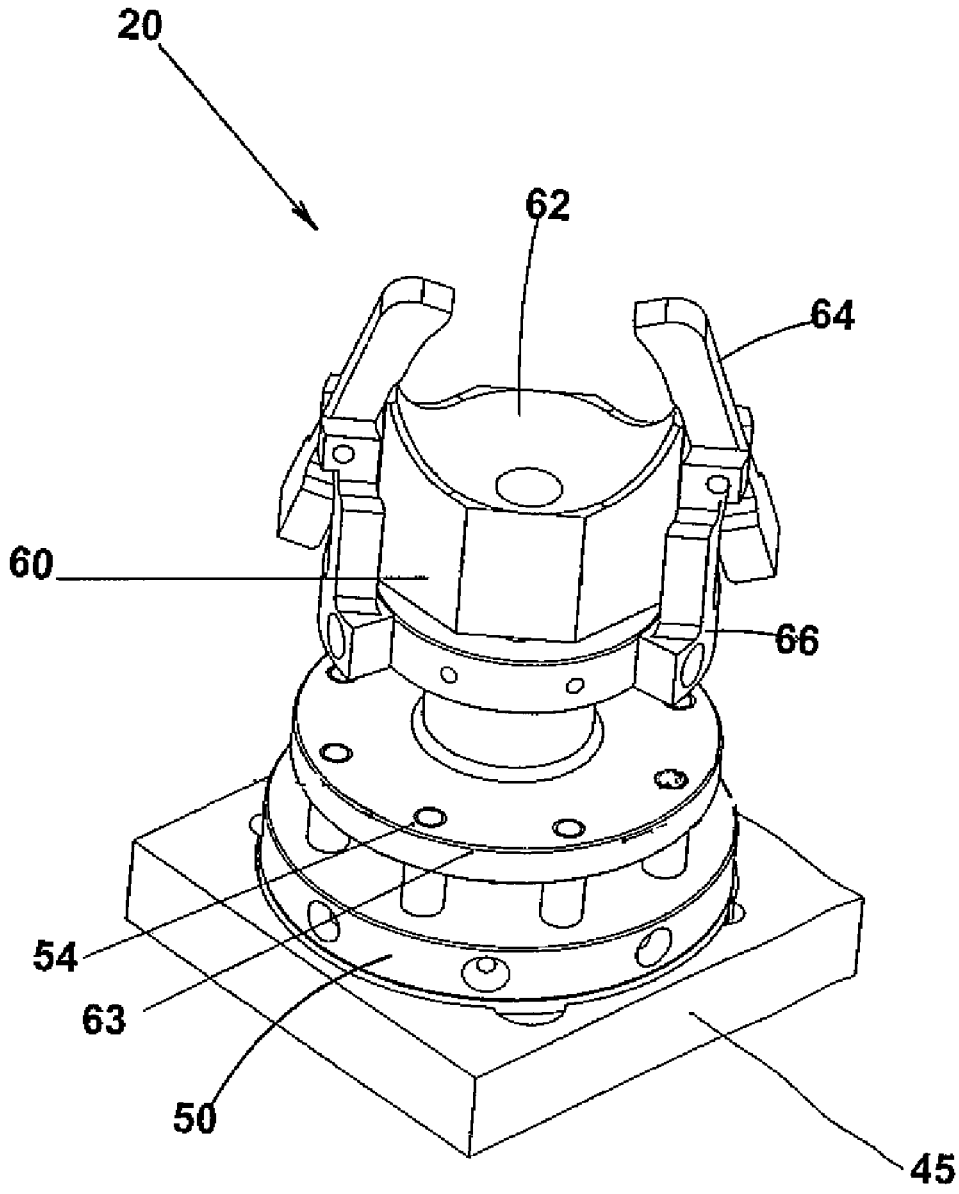
FIG. 3 is a perspective view of the magnetic indexing device of the present invention.
Figure 4:
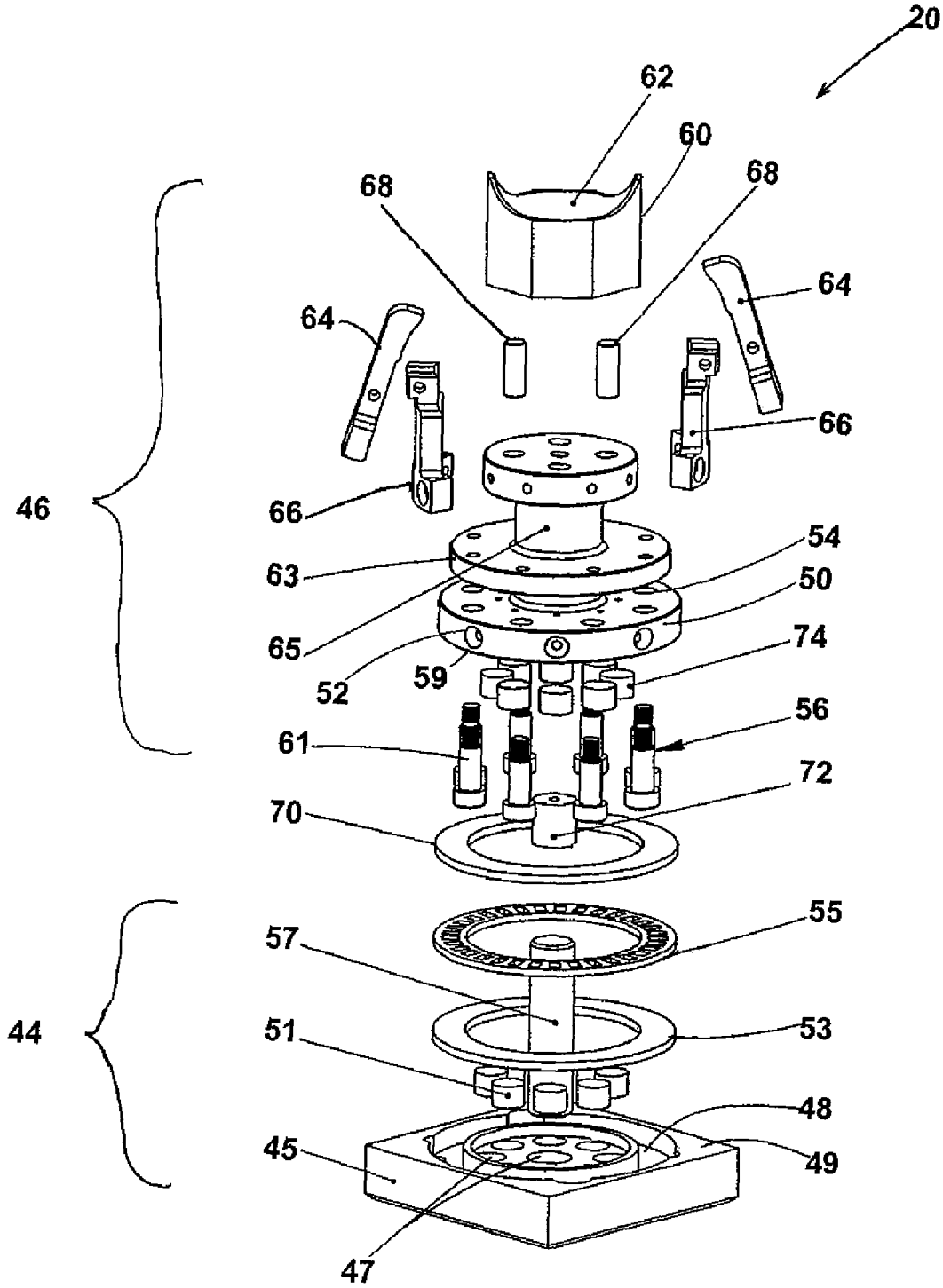
FIG. 4 is an expanded view of the device shown in FIG. 3.

As best shown in FIGS. 3 and 4, the device 20 includes two cooperating portions, a stationary base portion 44 and a rotating cup portion 46.

The stationary base portion 44 includes a square platform 45 that is mechanically connected to the conveyor sled 28 by well known means such as bolting the platform to a sled 28 that is integral with the conveyor 14; a plurality of recesses 47 are defined in the upper surface 49 of the platform 45, preferably eight (8), for seating a plurality of bottom magnets 51 with the north poles of the magnets facing upwards; a circular channel 48 is defined on the top surface 49 of the platform 45; a bottom metallic washer ring 53 is seated in the channel 48 and held in place by the magnetic force generated by the bottom magnets 51; a thrust bearing ring 55 is juxtaposed on top of the bottom washer ring 53 and it also is held by the magnetic force; and, an alignment pin 57 that is integral with the platform 45 and extends upwards to align the stationary base portion 44 to the rotating cup portion 46 when the two portions are brought together.

The rotating cup portion 46 comprises: a lower circular member 50, of a size and shape to be a positioned in the channel 48 of the base portion 44; the lower circular member 50 having a bottom surface 59 defining a plurality of recesses (not shown) for housing a corresponding number of top magnets 74, the south poles of which face downwards to create a magnetic locking force between the base and cup portions 44, 46; a plurality of threaded ports 52 are spaced about the outer perimeter of the lower circular member 50 for receiving tightening bolts which help secure the top magnets 74 in place; a circular aperture (not shown) is defined through the center of the rotating cup portion 46 for housing a bushing 72 which mates with the alignment pin 57 of the base portion 44 to facilitate joining the two portions 44 and 46; a circular upper member 63 supports the main body 65 of the rotating cup portion 46; the upper member 63 is connected to the lower circular member 50 by a plurality of shoulder bolts 56, preferably at least 8, which are threaded into the bottom surface of the upper member 63 and the unthreaded sections 61 provide spacing between the lower and upper circular members 50, 63 to create a bridge-like opening 54 (shown on FIG. 3), the function for which is described later; a hemispherical cavity cup 60 is friction fitted by dowel pins 68 to the main body 65; the cavity cup 60 having an inner surface 62 defining a reverse golf ball dimple pattern of the golf ball being processed; means for holding an oriented golf ball in place, the means include a pair of opposing flexible fingers 64 connected to the hemispherical cavity cup 60 and supported by a pair of brackets 66. The fingers 64 are pushed apart by a pair of parallel sliders, a left slider 24 and a right slider 25, the sliders straddling the conveyor 14 that will be discussed later; a metallic top washer 70 that is held by magnetic force to the bottom surface 59 of the lower circular member 50 is juxtaposed against the top surface of the ball bearing ring 55 therein magnetically locking the base and rotating cup portions 44, 46 to each other. When the rotating cup portion 46 is indexed in relationship to the base portion 44, the freedom of movement is aided by the thrust bearing ring 55 which creates a virtual frictionless rotation. Without the magnetic field, the two portions 44, 46 would spin free in relationship to each other.

Figure 2:
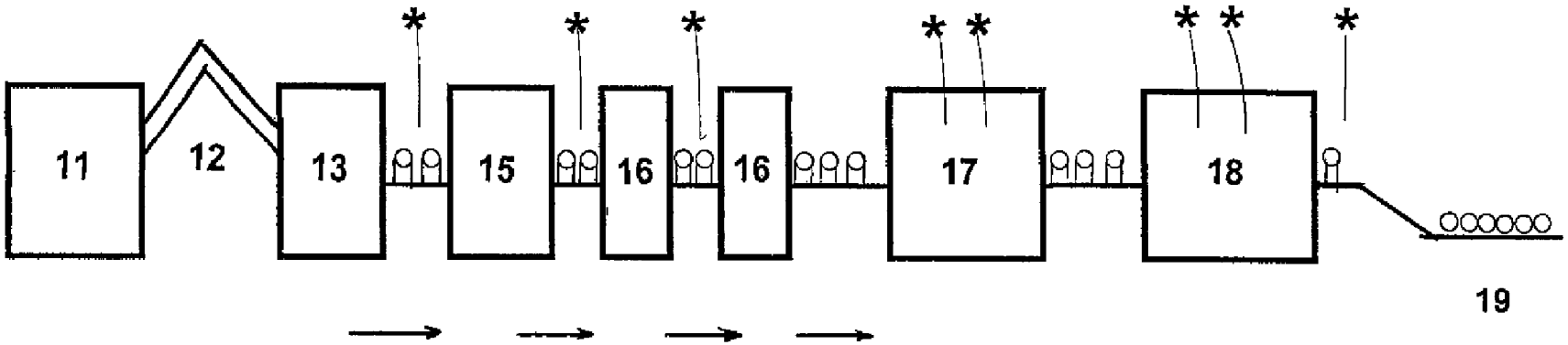
FIG. 2 is a schematic side view of a conveyor line apparatus that employs the cup device of the present invention.

The apparatus 10, as shown on FIG. 2, includes a hopper 11 wherein a multitude of golf balls (not shown) are loaded for the purpose of being printed with indicia. The balls are automatically moved by a lifter 12 to an orientation system 13 wherein each ball is oriented by an imaging station that uses software to load a complete pattern trajectory to a computer with a single communications transaction via Ethernet. Upon each ball being properly oriented, it is individually plucked and transferred by a robotic mechanism (not shown) and deposited into the hemispherical cavity 60 of the indexing devices 20. Each device 20 is one of a plurality of devices 20 that are affixed to conveyor sleds 28, and it is the function of the device 20 to securely hold the ball in the orientation that is required for the duration of the printing process. As best shown on FIGS. 1 and 6, the conveyor 14 employs a plurality of station locks 26 (preferably eight) along the entire length of the conveyor, with each lock having a an engaging cam surface 27. Each cam surface 27 can interlock with an open bridge section 54 defined in each device 20, and therein biasly break the magnetic force that holds the base and rotating portions 44, 45 together. After the open bridge section 54 intermeshes with the cam surface 27 of the station lock 26, the rotating cup portions 46 are biasly caused to be indexed to a new oriented position wherein a newly indexed ball surface is exposed to either, a printer pad, an inspection system, a UV drying system, or a removal element.

The process requires a station lock for each index. Thus, if after a first surface is printed upon, the ball must be then rotated by a station lock to expose another surface for printing, and the ball must be rotated again when the inspection of a second surface is required, and the ball must further be rotated for the curing process. The function of the station locks 26 is to break the magnetic attraction and biasly rotate the cup portion 46 to a new position and securely hold the cup portion (therein the ball) for the particular process step which includes printing, inspecting, curing, and removal from the cup. The function of the magnets 51 and 74 is to hold fast the device 20 while it travels between station locks 26, otherwise the cup portion 46 would spin freely in relationship to the base portion 44.

The magnetic indexing device 20 is the key component of the printing system described above and on FIG. 2. The mechanics of the process are best shown in FIGS. 5 to 9. Upon the ball being properly oriented by the orientation system 13, and plucked up to be deposited into a cup cavity 60, a pair of sliders, a left slider 24 and a right slider 25 operate in tandem to push open the flexible fingers 64 of the cup portion 46 therein opening the hemispherical cavity 60 to accommodate reception of a golf ball therein. As shown on FIG. 7, each slider 24, 25 has a slide base 30 anchored to the conveyor 14, with a slide table 32 mounted thereon, in which a pusher element 34 reciprocally slides back and forth and a pair of contact tips 36 engage and push the flexible fingers 64 at a low area which effectively causes the tips of the fingers 64 to spread apart and therein create an open position for the depositing of a golf ball. The robotic mechanism exactly transfers the ball from the orientation system 13 into the cavity cup 60 without any deviation in orientation. It is imperative for the present invention that each and every type of ball be of the same orientation when presented to the pad printers 16. Prior to accepting the oriented ball, the device 20 is first indexed by a station lock 26 (FIG. 6) and after acceptance of the oriented ball, a first vision inspection system 15 verifies that the ball is properly positioned. If it is not, then the ball is removed from the system. After passing the first vision inspection 15, the ball progresses along the conveyor 14 to the articulated pad printers 16 where two ball surfaces are exposed for printing indicia or logo thereupon with an UV curable ink. An option is available wherein printing can be performed of a top surface of the ball making it a total of three separate ball areas at this point. Next, if additional printing is to be done then the device is again indexed by another station lock which rotates and securely holds the ball for printing of indicia on up to two more ball surfaces. It is during the time that the device 20 moves between station locks that the magnetic field holds firmly the cup portion 46 to the base portion 44 of the device 20. Once a golf ball is printed with indicia (e.g., labels, logos, dimples, or other markings), the indicia is inspected by a second vision inspection system 17 to ensure compliance with a prescribed set of quality standards. For each separate printing operation that was performed, the device 20 must be rotated by a station lock to allow the vision inspection system 17 to have visual access to the indicia or logo. This inspection 17 is automatically performed by a line-scan vision system connected to a computer, which analyzes whether each indicium is acceptable. The UV curable ink is exposed to a UV light source 18 for curing and once again the device 10 must be rotated by a station lock for each printing procedure in order that the indicia be in view of the UV light source. Upon completion of the curing step, the device is subject to yet another station lock 26 which rotates the device in accordance of whether the ball is accepted or rejected. The rejected balls are removed from the system and the accepted balls are conveyed to an inspection table 19 for further processing.

The articulated pad printing system 16 utilizes ultraviolet ("UV") curable inks. UV inks are typically cured by means of UV light having wavelengths of from about 180 nm to about 380 nm. The advantages of using UV ink are that they are not fast and cure thoroughly, they are easy to use and are not affected by small changes in ambient conditions, they retain constant viscosity (i.e., they do not dry up quickly), and they use smaller amounts of combustible organic solvent such that little or no solvent fumes escape into the working environment and are, therefore, environmentally safer. Small amounts of solvent may be added to the UV inks for certain applications to enable the ink to transfer in a conventional manner. The inks may optionally contain additives such as binders, reactive prepolymers, thinners, low-viscosity mono and poly-functional monomers, photoinitiators to stimulate polymerization, stabilizing additives, flow control agents, wetting agents, pigments, extenders, or combinations thereof. The thickness of the ink film transferred to the golf ball can be any thickness that is sufficient to provide a clear image of the indicia or logo. This thickness can be from about 4 to 50 μm, preferably from about 4 to 20 μm. The thickness of the ink film can vary with the ink type and color, and is also influenced by the ink's viscosity, the pad material, the depth of etching in the plate and also environmental factors such as temperature, humidity, and so on.

The term "about" as used herein in connection with one or more numbers or numerical ranges, should be understood to refer to all such numbers, including all numbers in a range.

The invention described and claimed herein is not to be limited in scope by the specific embodiments herein disclosed, since these embodiments are intended solely as illustrations of several aspects of the invention. Any equivalent embodiments are intended to be within the scope of this invention. Indeed, various modifications of the invention in addition to those shown and described herein will become apparent to those of ordinary skill in the art from the foregoing description. Such modifications are also intended to fall within the scope of the appended claims

We claim:

1. A magnetic indexing device rotationally holding a golf ball for the printing of indicia on multiple surfaces of the ball, the indexing device comprising:

a stationary base portion connected to a sled on a conveyor and a rotating cup portion magnetically connected to the base portion;

means for substantially friction-free rotation between the base and cup portions; and means for receiving and holding the golf ball in the cup portion, wherein the cup portion is caused to be rotated in relationship to the base portion by a plurality of station locks attached to the conveyor which biasly causes the cup portion to be indexed for each printing, inspection, curing, and ball removal procedure.

2. The device of claim 1, wherein the base portion comprises:

a platform that attaches to the sled on the conveyor;

a plurality of recesses defined in the platform for seating a plurality of bottom magnets wherein the north poles of the magnets face upwards;

a circular channel defined in a upper surface of the platform; and the friction-free rotation means in the base portion includes a bottom washer magnetically seated in the circular channel and a thrust bearing ring juxtaposed on top of the washer.

3. The device of claim 2, wherein the rotating cup portion comprising:

a circular lower member of a size and shape for positioning to the circular channel;

the lower member having a plurality of top magnets disposed on a bottom surface with the negative poles facing downward to create a magnetic field between the base and cup portions; and the friction-free means in the cup portion includes a top washer magnetically held to the bottom surface of the lower circular member of the cup portion, the top washer frictionlessly gliding over the thrust bearing ring seated in the base portion.

4. The device according to claim 1, wherein the rotating cup portion comprises:

an upper member connected to the lower member by shoulder bolts wherein an open bridge section between the members is created by unthreaded areas of the bolts, wherein, a cam surface of a station lock can intermesh with the bridge section to cause the cup portion to be indexed in relationship to the base portion.

5. The device according to claim 1, wherein the receiving and holding means of the rotating cup portion comprises;

a hemispherical cavity cup connected to the upper member by a pair of dowel pins;

the cavity cup having an inner surface defining a reverse golf ball dimple pattern; and a pair of flexible fingers attached on opposing sides of the hemispherical cavity cup, wherein left and right slide mechanisms located on the conveyor biasly push against the fingers to cause them to spread apart, therein creating an opening to the cavity cup for the depositing of the golf ball.

6. The device according to claim 1, wherein the number of magnets in each portion is eight.

7. The device according to claim 1, wherein the base portion includes an alignment pin that friction fits to a bushing disposed in the rotating cup member, for quick attachment of the portions.

8. A magnetic indexing device for holding a golf ball for the printing of indicia on multiple surfaces of the ball, the indexing device comprising:

a stationary base portion magnetically connected to a rotating cup portion;

the base portion comprising:

a platform that attaches to a sled on a conveyor;

a plurality of recesses defined in the platform for seating a plurality of bottom magnets wherein the north poles of the magnets face upwards;

a circular channel defined in a upper surface of the platform; and a bottom washer magnetically seated in the circular channel and a thrust bearing ring juxtaposed on top of the washer; and the cup portion comprising:

a circular lower member of a size and shape for positioning to the circular channel;

the lower member having a plurality of top magnets disposed on a bottom surface with the negative poles facing downward to create a magnetic field between the base and cup portions;

an upper member connected to the lower member by shoulder bolts wherein unthreaded areas of the bolts create a space between the members that defines an open bridge section for engagement with an indexing means, and a hemispherical cavity cup connected to the upper member by a pair of dowel pins;

the cavity cup having an inner surface defining a reverse golf ball dimple pattern;

a pair of flexible fingers attached on opposing sides of the hemispherical cavity cup, that may be pushed into an open position for reception of the golf ball;

a top washer magnetically held to the bottom surface of the lower circular member of the cup portion, the top washer gliding substantially friction-free over the thrust bearing ring seated in the base portion when the cup portion is indexed in relationship to the base portion.

9. The device according to claim 8, wherein the number of magnets in each portion is eight.

10. The device according to claim 8, wherein the base portion includes an alignment pin that friction fits to a bushing disposed in the rotating cup member, for quick attachment of the portions.

* * * * *